US007324766B2

(12) United States Patent
Zona

(10) Patent No.: US 7,324,766 B2
(45) Date of Patent: Jan. 29, 2008

(54) CROSS-PROCESS CHARGE UNIFORMITY SCANNER

(75) Inventor: Michael Zona, Holley, NY (US)

(73) Assignee: Xerox Corporation, Norwalk, CT (US)

( * ) Notice: Subject to any disclaimer, the term of this patent is extended or adjusted under 35 U.S.C. 154(b) by 103 days.

(21) Appl. No.: 11/133,196

(22) Filed: May 20, 2005

(65) Prior Publication Data

US 2006/0263108 A1 Nov. 23, 2006

(51) Int. Cl.
*G03G 15/00* (2006.01)
*G03G 15/02* (2006.01)

(52) U.S. Cl. ..... 399/48; 399/73; 399/100

(58) Field of Classification Search ..... 399/48, 399/73, 100
See application file for complete search history.

(56) References Cited

U.S. PATENT DOCUMENTS 4,748,465 A * 5/1988 Tsilibes et al. ..... 347/140
5,081,492 A 1/1992 Hammond
5,384,623 A 1/1995 Ohashi et al.
5,481,337 A * 1/1996 Tsuchiya et al. ..... 399/46
5,978,616 A * 11/1999 Shin ..... 399/50
6,177,800 B1 1/2001 Kubby et al.
6,963,705 B2 * 11/2005 Quinones ..... 399/100
7,123,860 B1 10/2006 Zona
7,136,616 B2 * 11/2006 Mandel et al. ..... 399/388

FOREIGN PATENT DOCUMENTS

EP 1 003 044 A2 5/2000
JP A 61-267064 11/1986
WO WO 2004/088335 A1 10/2004

* cited by examiner

*Primary Examiner*—David M. Gray
*Assistant Examiner*—Joseph S. Wong
(74) *Attorney, Agent, or Firm*—Oliff & Berridge PLC

(57) ABSTRACT

In a xerographic printing apparatus, feedback on surface charge at a plurality of locations across a length of a photoreceptor may be desirable to assess charge uniformity, for example, to ensure color consistency across multiple marking engines in tightly integrated parallel printing architectures. A cross process charge uniformity scanner may include at least one micro-electro-mechanical based electrostatic voltmeter device for measuring surface charge at a plurality of locations along the length of the photoreceptor. The charge uniformity scanner may allow the xerographic printing apparatus to initiate charge device cleaning and/or control the intensity of the charge applied to the surface of the photoreceptor. Exemplary embodiments may include an electrostatic voltmeter moveably mounted along the length of the photoreceptor in the fast scanning direction, or may include a plurality of electrostatic voltmeters disposed at spaced apart locations along the length of the photoreceptor.

5 Claims, 5 Drawing Sheets

CROSS-PROCESS CHARGE UNIFORMITY SCANNER

Cross-reference is made to commonly assigned application, U.S. patent application Ser. No. 11/115,151, filed Apr. 27, 2005, entitled "Small Footprint Charge Device for Tandem Color Marking Engines," the entire disclosure of which is incorporated herein by reference.

BACKGROUND

The present disclosure relates to electrostatographic printing and/or xerography systems. Specifically this disclosure relates to in-situ machine measurement of photoreceptor charging uniformity in marking engines within xerographic systems.

In electrostatographic systems, a photoreceptor may be supported by a mechanical carrier, such as a drum or a belt. The photoreceptor may be charged to a generally uniform charge by subjecting the photoreceptor to a suitable charging device. The charge distribution on the photoreceptor may then be altered by the application of radiation, e.g., a laser, to the surface of the photoreceptor. The toner particles adhere electrostatically to the suitably charged portions of the photoreceptor. The toner particles may then be transferred, by the application of electric charge to a print sheet or intermediate belt, forming the desired image on the print sheet or intermediate belt. An electric charge may also be used to separate or "detack" the print sheet from the photoreceptor.

The charge uniformity of the photoreceptor bears a direct relationship on the quality of the work product of the xerographic system. Control systems for uniform charge distribution requires monitoring the charge disposed on the photoreceptor and has been made possible by advances in non-contacting electrostatic voltmeters (ESV's) which measure the surface voltage of the photoreceptor. Based upon micro-electro-mechanical (MEM) modulation technology, non-contacting ESV's have been reduced in size to be adaptable to the reduced footprint available on the surface of photoreceptors made smaller by the overall reduction in size of the xerographic system.

An exemplary method and apparatus for use in an ESV is discussed in U.S. Pat. No. 6,177,800 to Kubby et al. ("Kubby"), and is incorporated by reference in its entirety. Kubby discloses a MEM based ESV device that includes a sense probe assembly having a plurality of sense probes for measuring voltage by capacitive coupling.

SUMMARY

An area of ongoing research and development is in reducing the overall size of electrostatographic system components towards the goal of an economical and capacity-extendible all-in-one process cartridge for easy adaptive use in a family of compact electrostatographic reproduction machines having different volume capacities and consumable life cycles. Furthermore, multiple smaller tandem marking engines may be advantageously used in parallel engines to increase machine throughput.

However, as photoreceptors get smaller and smaller, so does the limit on the number of ESV probes that can be used in process control due to waterfront constraints. Use of ESV probes at fixed locations along the photoreceptor may provide feedback regarding average charged voltage, but provides no cross process uniformity information. Feedback on the uniformity of the charge across the length of the photoreceptor may be desirable in process control to ensure color consistency across multiple integrated marking engines (IMEs) in tightly integrated parallel printing (TIPP) architectures. If a charge uniformity scan is performed during setup, machine power-up, or at predetermined intervals during long run jobs, process control capabilities to restore charging uniformity may include:

- engaging an automatic charge device cleaning if charge non-uniformity reaches a pre-determined level by actuating a motor that traverses brushes or pads that scrub the corona generating devices;
- flagging the charge device or replaceable unit (RU) for replacement or service, i.e. wire replacement, customer replacement unit (CRU) replacement, and the like, if automatic cleaning was not successful in restoring uniformity;
- modifying the fast scan exposure intensity of a radiating device, for example, a laser, based upon the voltage measured by the scanning electrostatic voltmeter (ESV), thereby compensating for the low uniformity by increasing or decreasing the exposure/intensity level in the fast scan direction; and/or
- sending high area coverage jobs, that is, print jobs requiring more uniformity, to more uniform IMEs to ensure good uniformity and color consistency in work product, and send text, or line type jobs requiring less uniformity, to the non-uniform IME.

Exemplary embodiments of disclosed herein apparatus and methods to provide cross-process charge uniformity information take advantage of the small footprint and reduced packaging of MEMS based ESV devices to enable mounting of ESV devices in locations and configurations previously unavailable.

An exemplary embodiment of a cross-process charge uniformity scanner may comprise mounting an ESV on the sliding portion of an automatic charge device cleaner in a xerographic device. The charge device cleaner may incorporate a lead screw or similar method known in the art to traverse the cleaning pads or brushes from one end of the photoreceptor to the other in a direction transverse to the fast scanning direction of the light radiation device. Attaching the ESV to the portion of the cleaner that moves across the process may allow surface voltage data to be recorded for the entire process while in motion, thereby acquiring a assessment of uniformity scan.

Another exemplary embodiment of a cross-process charge uniformity scanner may take advantage of the small size of MEMS based ESV devices to incorporate a plurality of ESV devices disposed at spaced apart locations along the length of the photoreceptor in an axis transverse to a slow scanning direction of the photoreceptor.

Thus, exemplary embodiments of MEMS ESV devices incorporated in a xerographic device may allow the xerographic device to assess charge uniformity and ensure color consistency across multiple imaging devices in tightly integrated parallel printing architectures.

BRIEF DESCRIPTION OF THE DRAWINGS

Various exemplary embodiments are described in detail, with reference to the following figures, wherein.

DETAILED DESCRIPTION OF EMBODIMENTS

Figure 1:
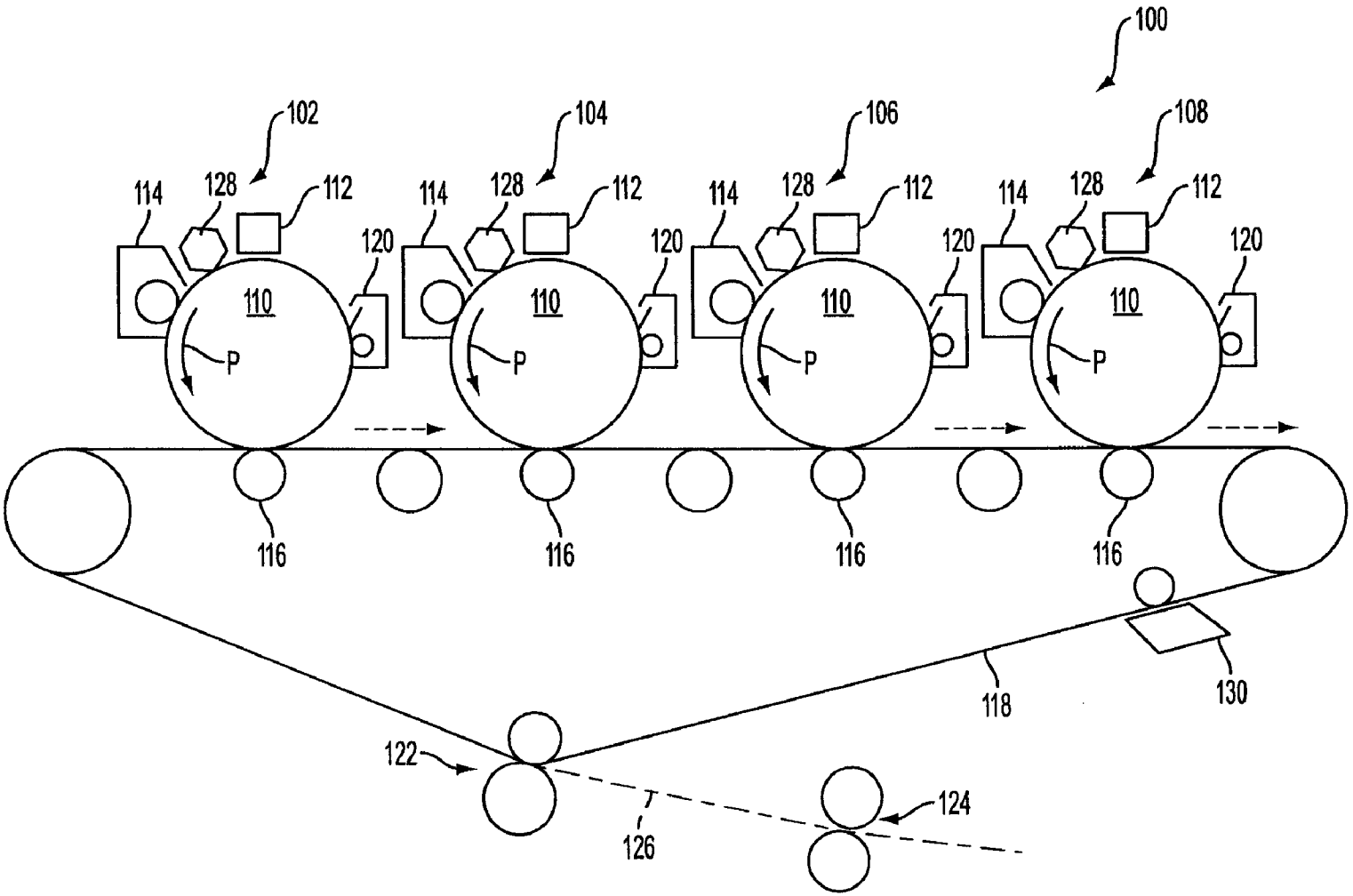
FIG. 1 is an elevation view of a xerographic device showing elements of an electrostatographic or xerographic printer including a charge uniformity scanner for determining cross process charge uniformity of a photoreceptor.

The following-detailed description makes specific reference to xerographic devices, such as illustrated in FIG. 1, and is particularly directed to apparatus and methods to perform in-situ xerographic device measurement of photoreceptor charge uniformity and may be used to automatically change defined subsystem and system settings to try to restore charging uniformity.

It should be understood that the principles and techniques described herein may be used in other devices and methods, for example, color as well as monochrome printers, photoreceptor drum as well as belt supported systems, raster output scanner (ROS) systems as well as electrostatographic devices utilizing direct writing techniques such as full width array (FWA) LED imaging. The embodiments described are illustrative and non-limiting.

FIG. 1 illustrates elements of an electrostatographic and/or xerographic color marking engine 100, such as a copier or a "laser printer." The marking engine 100 may include four tandem process cartridges 102-108, each providing one of three primary colors, typically cyan, magenta and yellow, and in addition, optionally black. Each process cartridge 102-108 may function similarly. As such, only the operation of a single process cartridge is discussed as representative of all four process cartridges.

Figure 2:
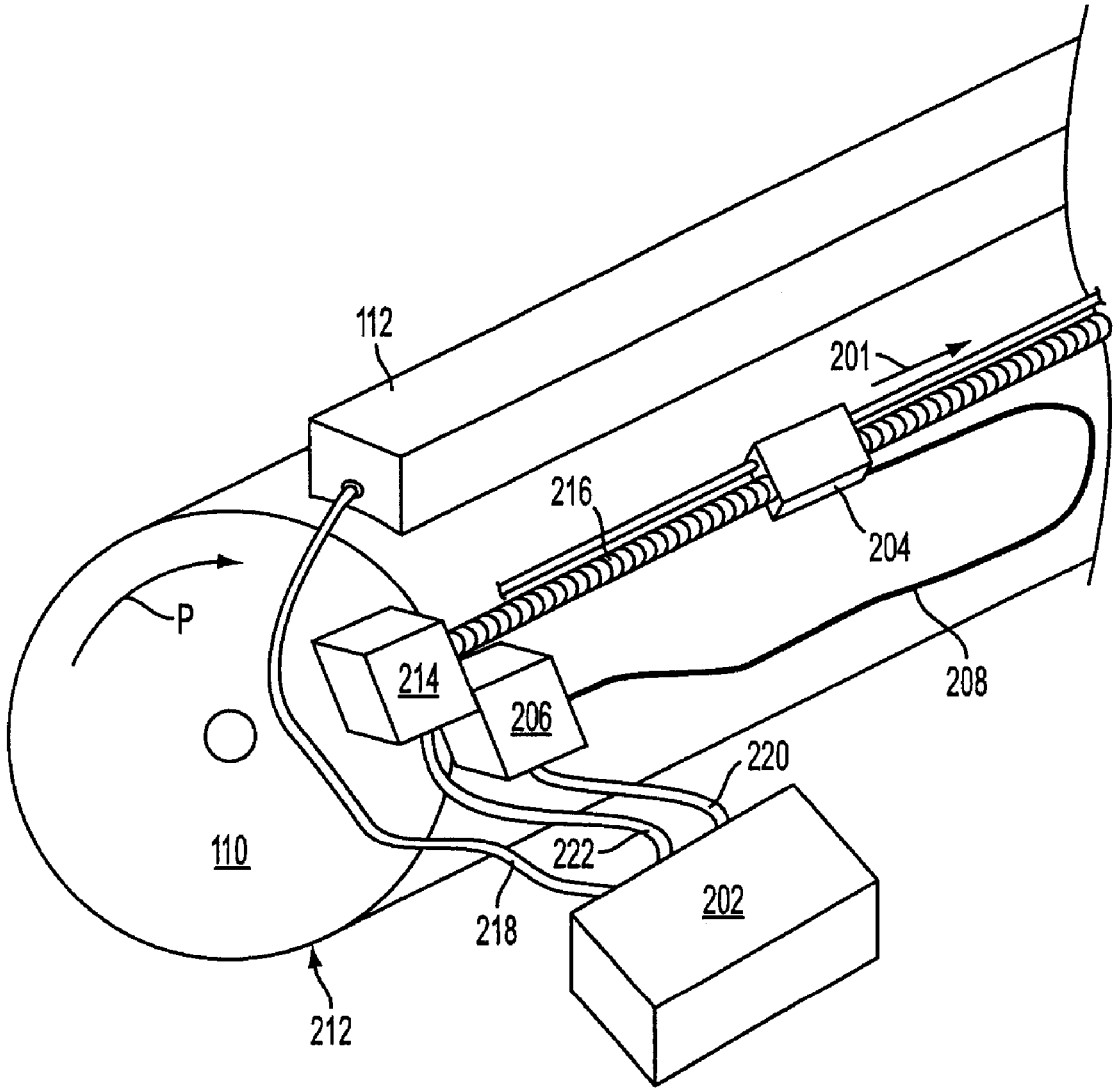
FIG. 2 illustrates an exemplary embodiment of the xerographic device of FIG. 1 including a micro-electro-mechanical system (MEMS) based electrostatic voltmeter (ESV) device moveable in a direction along the length of a photoreceptor.
Figure 3:
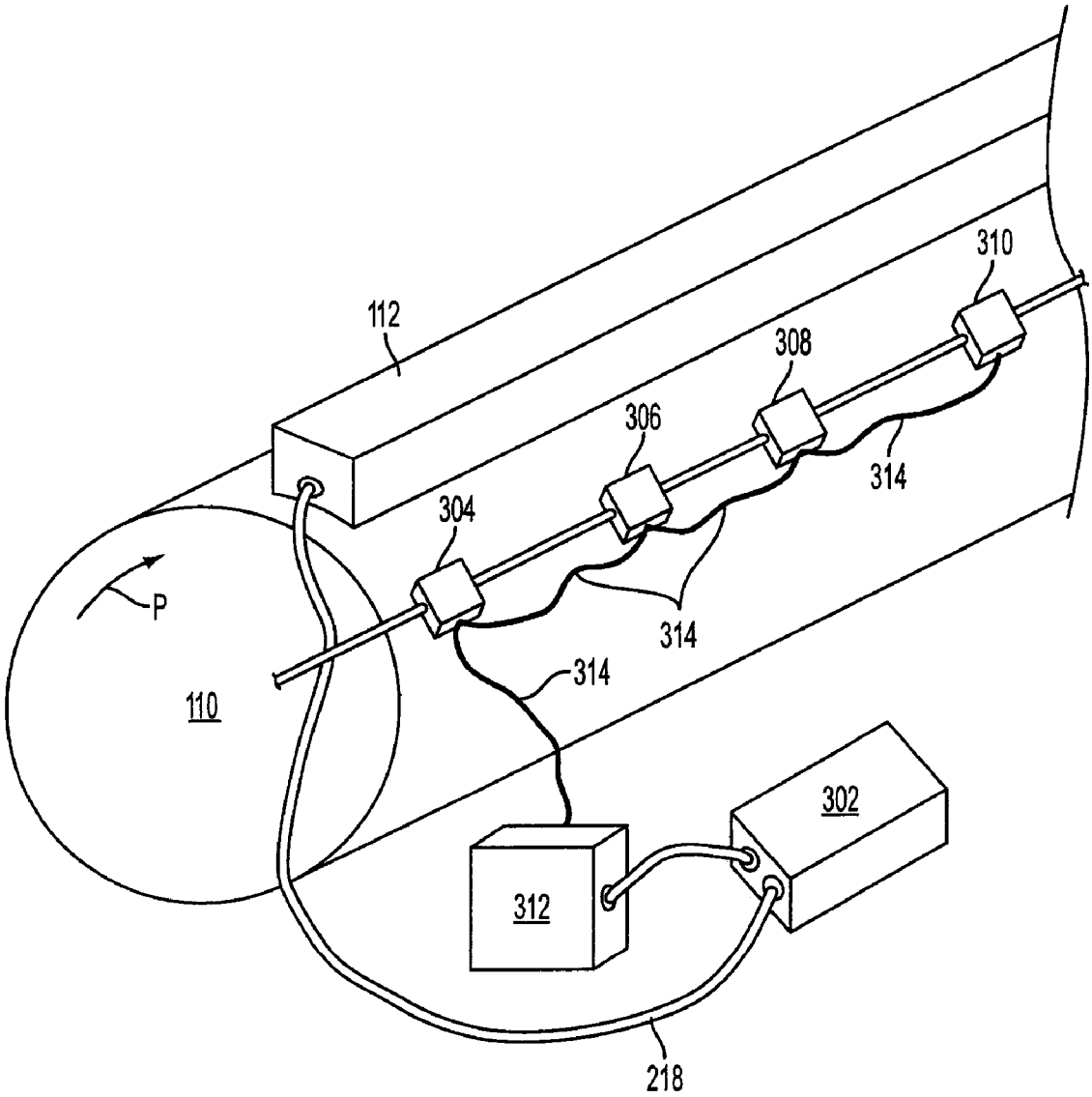
FIG. 3 illustrates an exemplary embodiment of the xerographic device of FIG. 1 including a plurality of spaced apart MEMS based ESV devices along the length of a photoreceptor.

Each process cartridge may comprise a photoreceptor 110, which although shown in FIGS. 1-3 as a drum 110, may be in the form of a belt or other photoreceptive transfer medium. The photoreceptor 110 may define a charge-retentive surface for forming electrostatic images thereon. The photoreceptor 110 may be rotated in a process direction P.

The first step in the process may be an initial charging of a relevant surface of the photoreceptor 110. This initial charging may be performed by a charge device 112 that imparts an electrostatic charge on the surface of the photoreceptor 110 rotating past the charge device 112. A charge uniformity scanner 128 may then assess the uniformity of the applied charge by measuring the surface charge on the photoreceptor 110 in at least one location along the length of the photoreceptor 110. Based on the assessment of the charge uniformity, several options are available to try to restore charging uniformity, trigger a critical replacement unit (CRU) which may include a charge device 112 replacement, or setting a warning flag.

The charged portions of the photoreceptor 110 may then be selectively discharged in a configuration corresponding to a desired image to be printed, for example, by a raster output scanner (ROS), not shown, which generally comprises a laser source and a rotatable mirror which act together, in a manner known in the art, to discharge certain areas of the surface of photoreceptor 110 according to the desired image to be printed.

Although a laser may be used to selectively discharge the surface of the photoreceptor 110, other apparatus that may be used for this purpose may include an LED bar, or, in a copier, a light-lens system. The laser source may be modulated (turned on and off) in accordance with digital image data fed thereto, and the rotating mirror may cause the modulated beam from laser source to move in a fast-scan direction perpendicular to the process direction P of the photoreceptor 110.

After certain areas of the photoreceptor 110 are discharged, the remaining charged areas may be developed by a developer unit 114, for example, causing a supply of dry toner to contact or otherwise approach the surface of photoreceptor 110. The developed image may then be advanced, by the motion of photoreceptor 110, to a bias transfer roller, or transfer station 116, for example, causing the toner adhering to the photoreceptor 110 to be electrically transferred to a common intermediate transfer belt 118. Any residual toner remaining on the photoreceptor 110 may be removed by a cleaning blade 120 or equivalent device.

After each process cartridge 102-108 transfers its image to the belt 118, the complete color image may be transferred at transfer station 122 to a medium, such as a sheet of plain paper 126, to form the image thereon. Belt cleaner 130 may clean the transfer belt 118 of any residual toner. The sheet of plain paper 126, with the toner image thereon, may then be passed through a fuser 124, for example, causing the toner to melt, or fuse, into the sheet of paper 126.

Although the color process cartridges shown in FIG. 1 may operate within a tandem color marking engine, corresponding elements may operate in other color marking engines including a single photoreceptor with multiple exposure and development devices, as well as in monochrome printers including a single photoreceptor and a single exposure and development device.

Furthermore, the photoreceptor 110 and uniformity scanner 128 may be configured as part of a cartridge that is readily removable and replaceable, relative to a larger printing apparatus. Such removable cartridges may further include a supply of marking material and/or a fusing mechanism.

The following detailed description of exemplary embodiments is particularly directed to cross-process charge uniformity scanning apparatus and methods incorporating micro-electro-mechanical systems (MEMS) based electrostatic voltmeter (ESV) devices to measure the voltage on the surface of a photoreceptor.

The following detailed description makes specific reference to xerographic devices, such as illustrated in FIG. 1 as well as MEMS based ESV devices, as disclosed in U.S. Pat. No. 6,177,800 incorporated by reference in its entirety. However, it should be understood that the principles and techniques described herein may be used in conjunction with other ESV devices and in other photoreceptor configurations and methods. These configurations and methods may include, for example, color as well as monochrome printers, photoreceptor drum as well as belt supported systems, raster output scanner (ROS) systems as well as electrostatographic devices utilizing direct writing techniques such as full width array (FWA) LED imaging.

FIG. 2 is an exemplary embodiment illustrating subassemblies of marker engine 102 and charge uniformity scanner 128 (FIG. 1), and may include a processor assembly 202 in communication with a charge device 112 and a charge uniformity scanner interface unit 206, through cables 218 and 220 respectively. Although the processor assembly 202 may control operation of a number of other subassemblies including the cleaning assembly 120 as well as the developer unit 114 (FIG. 1), alternate embodiments of the xerographic device 100 may comprise distributed processors including a separate processor to control the operation of the charge uniformity scanner 128.

Digital circuit designs incorporating both single processor designs and distributed processors are known to those of ordinary skill in the art and the exemplary embodiments herein described are non-limiting.

The charge uniformity scanner 128, of FIG. 1, may further comprise an ESV device 204 slideably mounted so as to measure charge intensity on the surface 212 of the photoreceptor 110 as the ESV device 204 traverses the length of the photoreceptor 110 in a fast scanning direction 201. The method by which the ESV device 204 may be caused to traverse the length of the photoreceptor 110 may take advantage of elements already disposed in the xerographic device 100. Charge device cleaning assemblies 140 are used to clean toner or other contamination from the corona generating portions of the charge device 112 and may include a drive mechanism, such as a motor and a screw drive to advance the cleaning pads or brushes in a fast scanning direction 201. The ESV device 204 may likewise be slideably mounted to a screw drive 216 driven by motor 214, connected by a cable 222 to the processor assembly 202, so as to measure a charge deposited along the length of the photoreceptor 110 as the ESV device 204 is advanced in a fast scanning direction 201.

At setup, machine power-up, or at predetermined intervals during long run jobs, the processor assimbly 202 may initiate a uniformity assessment scan of the photoreceptor 110 whereby the screw drive 216 is rotated, causing the ESV device 204 to traverses the length of the photoreceptor 110, while measuring charge intensity at a plurality of locations on the surface 212 of the photoreceptor 110.

The measured charge intensity at the plurality of locations may then be transmitted to the interface unit 206 through cable 208. Cable 208 may be of sufficient length and flexibility so as to allow the ESV device 204 to freely traverse back and forth across the length of the photoreceptor 110.

The output signal of the ESV device 204 may be a digital signal which is received by the interface unit 206 and is then made available to the processor assembly 202. Alternatively, the ESV device 204 may provide an analog signal output which may be converted to a digital signal by an A/D converter (not shown) within the interface unit 206. A/D converters are known to those of ordinary skill in the art and the specific implementation of the A/D converter is non-limiting. Regardless of whether the output of the ESV device 204 is analog or digital, a plurality of measured voltage readings at spaced apart intervals on the surface of the photoreceptor serve as input to the processor assembly 202 which determines the charge uniformity of the photoreceptor 112.

FIG. 3 illustrates an alternate exemplary embodiment of a charge uniformity scanner 128 of FIG. 1, comprising an interface unit 312 receiving input from a plurality of spaced apart ESV devices 304-310, each ESV device presenting a waterfront footprint of approximately 3-6 mm at pre-determined locations along the length of the photoreceptor 110. The exemplary embodiment illustrated in FIG. 3 may be advantageous in certain applications where it may not be feasible, desirable or cost effective to implement a single moveable ESV device. Such applications may include, for example, electrostatographic devices not having an automatic cleaning device having a drive mechanism, or where the unit price of an ESV device may justify multiple ESV devices.

Similar to the processor assembly 202 in FIG. 2, the processor assembly 302 assesses charge uniformity based upon a plurality of voltage measurements. However, unlike the embodiment shown in FIG. 2, the plurality of voltage measurements are obtained from a plurality of spaced apart ESV devices 304-310. The output of each of the ESV devices 304-310 are wired by wires 314 to the interface unit 312 and under processor control may be gated through an analog gate and A/D converter within interface unit 312 to selectively output a measured voltage from each of the ESV devices 304-310 to the processor assembly 302.

Without the requirement of a fixed mounting point for a flexible cable 208 from the moveable ESV device 204 shown in FIG. 2, an alternate exemplary embodiment may locate the analog gate, the A/D converter and the rest of the logic contained within the interface unit 312 into the processor assembly 302. The physical location of components required to perform the charge uniformity diagnostic functions described herein is based upon manufacturing analysis and is non-limiting.

Figure 4:
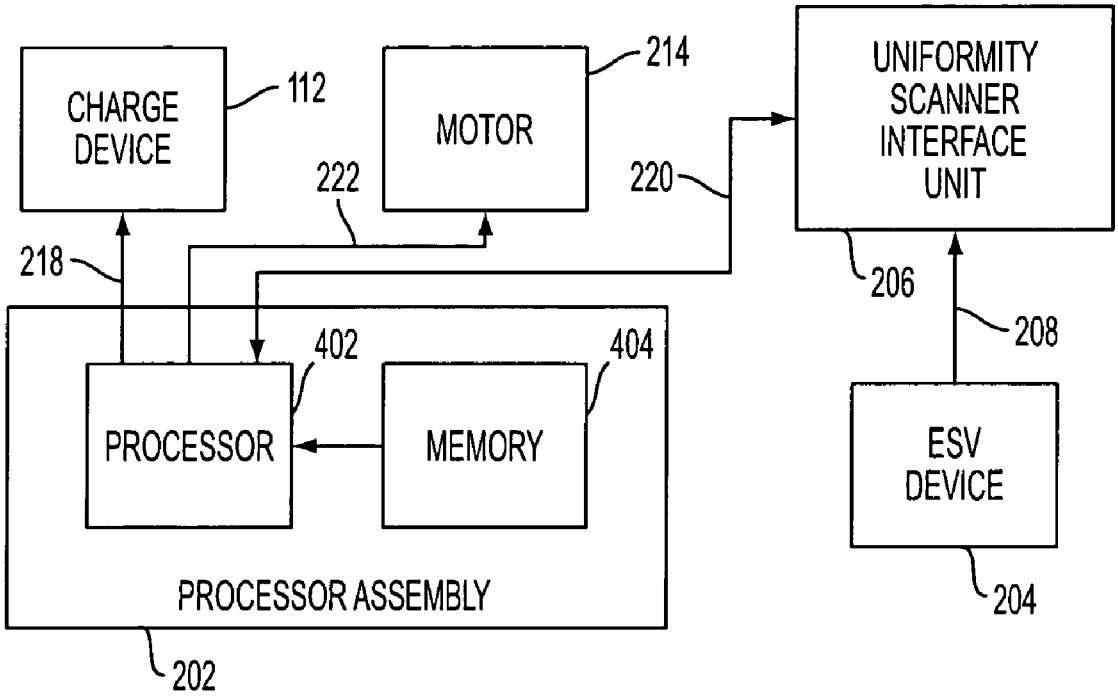
FIG. 4 is an exemplary functional block diagram of the charge uniformity scanner of FIGS. 1-3.

FIG. 4 illustrates an exemplary functional block diagram of the voltage uniformity scanner embodiment as shown in FIG. 2. As discussed above, the processor assembly 202 may control the uniformity scanner 128, the charge device 112, the cleaning assembly 120 as well as the developer unit 114. The processor assembly 202 may include a processor 402, a memory 404 accessible to the processor 402, and control leads to other subassemblies including the charge device 112 and the drive mechanism 212.

Program instruction code stored in the memory 404 may configure the processor 402 to control the operation of the charge uniformity scanner 128, the charge device 112 and the drive mechanism 212 based on an assessed charge uniformity of the photoreceptor 110. Specifically, the program instruction code may direct the processor 402 to assess charge uniformity based upon a plurality of spaced apart measurements of the photoreceptor 110 taken by the ESV device 204. Charge uniformity may, for example, be determined as the statistical mean of spaced apart voltage measurements. Low uniformity as well as other calculations, which may include deviations from the mean at specific locations, may trigger automatic attempts to restore uniformity and/or to initiate diagnostics and CRU replacement.

As discussed above, the implementation of the processor 402 and memory 404, is non-limiting, and the program instruction code implementing the functionality of the charge uniformity scanner 128 may be incorporated within an alternative memory device or may be accessed by an alternate processor within the xerographic device 100.

An exemplary implementation of the charge uniformity scanner 128 may include a uniformity scan performed during apparatus setup, apparatus power-ups, or at predetermined intervals during long run jobs. The program instruction code may be configured to: activate the drive mechanism 212 to cause the ESV device 202 to traverse the length of the photoconductor measuring voltage levels at spaced apart intervals; assess charge uniformity based upon the plurality of measurements; and based upon the assessed charge, the control processor 204 may further attempt to restore charge uniformity by one or more of: controlling the intensity of the applied charge and/or adjust discharge levels applied by the light radiation device; direct automatic cleaning of the charge device 112; and setting a maintenance flag and/or generate a maintenance report or message, indicating the need for a customer replacement unit (CRU) replacement.

A block diagram illustrating the uniformity scanner embodied in FIG. 3 would replace the single ESV device with a plurality of ESV devices and would not include control logic/programming to activate a drive mechanism.

Figure 5:
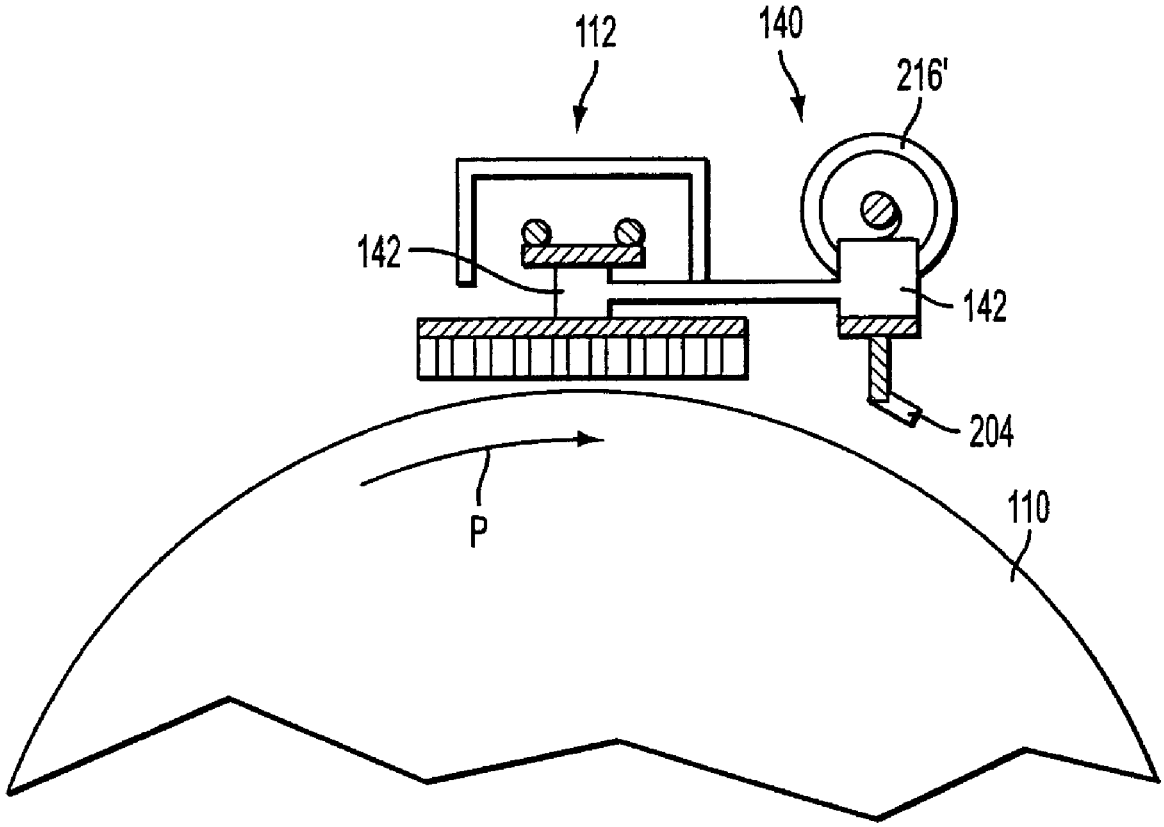
FIG. 5 is an exemplary embodiment of an alternative xerographic device similar to FIG. 2, but having the ESV mounted on a sliding portion of an automatic charge cleaner device.

It will be appreciated that various of the above-disclosed and other features and functions, or alternatives thereof, may be desirably combined into many other different systems or applications. For example, in FIG. 5, a xerographic device similar to FIG. 2 may be provided with an automatic charge device cleaner 140 used to clean contamination or toner from corona generating portions of the charge device 112. Such an automatic charge device cleaner 140 includes a lead screw 216' or other device driven to traverse cleaning pads mounted to a sliding portion 142 of the cleaner across the photoreceptor 110 from one end of the photoreceptor to the other in a direction transverse to the fast scanning direction as shown. In this embodiment, the ESV 204 is mounted on the sliding portion 142 of the charge device cleaner 140 that moves across the photoreceptor 110. In this example, both the ESV 204 and the sliding portion 142 of the charge device cleaner 140 are commonly mounted on the lead screw 216' to share a common drive mechanism. Also, various presently unforeseen or unanticipated alternatives, modifications, variations or improvements therein may be subsequently made by those skilled in the art and are also intended to be encompassed by the following claims.

What is claimed is:

1. A xerographic device, comprising:

a photoreceptor;

a charge uniformity scanner including at least one electrostatic voltmeter arranged to measure a surface charge intensity at a plurality of locations in a fast scanning direction of the photoreceptor;

a charge device; and a cleaning device that cleans a surface of the charging device, wherein the charge device is configured to apply a charge intensity to the surface of the photoreceptor, and both the cleaning device and the at least one electrostatic voltmeter are commonly mounted for movement in the fast scanning direction of the photoreceptor by a drive mechanism.

2. A method of assessing charge uniformity of a photoreceptor, comprising:

applying a level of charge intensity to a surface of a photoreceptor using a charging device;

measuring the charge intensity on the surface of the photoreceptor at a plurality of locations along a fast scanning direction of the photoreceptor surface by advancing a charge uniformity scanner in the fast scanning direction using a drive mechanism;

assessing charge uniformity along the surface based upon the measured charge intensity of the photoreceptor at the plurality of locations; and directing cleaning of the charge device used to apply the charge intensity based upon the assessed charge uniformity by advancing a cleaning device in the fast scanning direction using the same drive mechanism which advances the charge uniformity scanner.

3. The method of claim 2, further comprising: identifying the charge device as needing replacement based on the assessed charge uniformity.

4. The method of claim 2, further comprising controlling the intensity of the charge applied to the surface of the photoreceptor based on the assessed charge uniformity.

5. The method of claim 2, wherein the method is performed in-situ on at least one photoreceptor of at least one marking engine of a xerographic device to perform in-situ xerographic device measurement of photoreceptor charge uniformity across a photoreceptor surface.

* * * * *